United States Patent [19]

Vandersyde et al.

[11] Patent Number: 4,728,097

[45] Date of Patent: Mar. 1, 1988

[54] ADJUSTABLE GRIPPER ARM

[75] Inventors: Gary L. Vandersyde, Naperville; Kenneth G. Viani, Morton Grove; Paul J. Beatty, Chicago, all of Ill.; Winston A. Orsinger, Nazareth, Pa.

[73] Assignee: Bell & Howell Company, Chicago, Ill.

[21] Appl. No.: 826,397

[22] Filed: Feb. 5, 1986

[51] Int. Cl.[4] ..... B65H 5/10

[52] U.S. Cl. ..... 271/268; 271/263; 414/740

[58] Field of Search ..... 901/38, 39; 271/262, 271/263, 268; 294/104; 414/740, 730; 270/56

[56] References Cited

U.S. PATENT DOCUMENTS

| | | | |
|---|---|---|---|
| 1,049,492 | 1/1913 | Juengst | 270/56 |
| 1,109,127 | 9/1914 | Juengst | 270/56 |
| 3,191,031 | 6/1965 | Sano et al. | 250/68 |
| 3,347,348 | 10/1967 | Flint et al. | 198/30 |
| 3,744,787 | 7/1973 | Morrison | 270/56 |
| 3,871,639 | 3/1975 | Felix | 270/52 |
| 3,885,780 | 5/1975 | Morrison | 270/56 |
| 4,173,427 | 11/1979 | Beuch et al. | 414/751 |
| 4,284,301 | 8/1981 | Geiger et al. | 294/104 |
| 4,448,056 | 5/1984 | Baba | 414/740 X |
| 4,462,585 | 7/1984 | Gieson et al. | 271/263 X |
| 4,511,130 | 4/1985 | Barton et al. | 271/268 X |
| 4,634,107 | 1/1987 | Vandersyde et al. | 414/730 X |

*Primary Examiner*—H. Grant Skaggs
*Assistant Examiner*—Nils E. Pedersen
*Attorney, Agent, or Firm*—Griffin, Branigan & Butler

[57] ABSTRACT

The size of the gap separating first and second jaw members (26, 28) comprising a gripper arm is made adjustable by the provision of a translatable bracket (80) upon which an actuator (30) is supported. As the bracket (80) translates, so do the actuator (30) and a linkage (32) which connects a pivotable jaw member (28) to the actuator (30). Translation of the actuator (30) and linkage (32) changes the size of the gap separating the pivotable jaw member (28) and the other jaw member (26), thereby permitting the gripper arm to accommodate and engage articles of differing thicknesses.

20 Claims, 5 Drawing Figures

ADJUSTABLE GRIPPER ARM

BACKGROUND

I. Field of the Invention

This invention pertains to gripper arm apparatus, particularly gripper arms employed in collating machines such as an insertion machine, and to methods of operating such machines which utilize gripper arms.

II. Prior Art and Other Considerations

U.S. Pat. No. 4,634,107 entitled GRIPPER ARM AND METHOD OF OPERATION, commonly assigned herewith and incorporated herein by reference, discloses a gripper arm wherein a movable gripper jaw is actuated by a solenoid acting through a linkage to engage articles between the movable jaw and another jaw, and thereafter to release the articles. The solenoid is assisted by biasing means which is preloaded to facilitate the application of a desired holding force on articles engaged between the jaw members. When the solenoid is not actuated, the gripper jaws are spaced apart from one another by a gap or distance which is a function of such factors as the length of the jaws from a pivot point and the impact of the effective length of the linkage (taking into consideration the effect of the biasing means when the solenoid is not activated) upon the positioning of the movable gripper jaw. When the solenoid is activated, it is contemplated that the gripper jaws would touch one another if an article such as an insert were not gripped therebetween.

In operating collating or insertion machines employing gripper arms such as that described above, in differing batches or runs it is often required that a gripper arm engage and release articles (such as sheets) of a variety of different thicknesses. For example, during a first batch an insert hopper associated with a gripper arm may be loaded with inserts of very thin paper, but during a second batch the same insert hopper may be loaded with inserts of much thicker paper stock. Despite the change in insert thickness from batch to batch, for the prior art solenoid-actuated gripper arms the gap separating the gripper jaws when the solenoid is not activated remains essentially uniform.

For some embodiments of prior art solenoid-actuated gripper arms the jaws may not be sufficiently separable to accommodate and then engage very thick articles therebetween. It would be highly desirable, therefore, to provide a gripper arm which could accommodate thick articles between its jaws without having to change the dimensions of basic structural items such as the length of the jaws, the length of the linkages, and the length of the solenoid plunger stroke.

U.S. Pat. Nos. 3,744,787 and 3,885,780 to Morrison show prior art method and apparatus employing a plurality of adjustment screws for adjusting a gripper arm to accommodate inserts of different thicknesses. The Morrison patents, predating the advent of the solenoid-actuated gripper arm, show apparatus not optimally suited for operation with the solenoid actuator and linkage of the incorporated application.

In view of the foregoing, it is an object of the present invention to provide a gripper arm and method of collating machine operation wherein the distance separating the jaw members of an electrically actuated gripper arm is selectively adjustable.

Another advantage of the present invention is the provision of an adjustable gripper arm wherein an adjustment for changing the distance separating gripper jaw members is easily made by a single operation.

Yet another advantage of the present invention is the provision of method and apparatus for adjusting the position of gripper jaws of a solenoid-actuated gripper arm.

An advantage of the present invention is the provision of an adjustable gripper arm having means for indicating the degree of a selected adjustment.

A further advantage of the present invention is the provision of means for apprising an operator (standing on the backside of a gripper arm) that the gripper jaws (located on the front side of a gripper arm) have been sufficiently adjusted for the articles to be engaged between the jaws.

SUMMARY

The size of the gap separating first and second jaw members comprising a gripper arm is made adjustable by the provision of a translatable bracket upon which an actuator is supported. As the bracket translates, so do the actuator and a linkage which connects a pivotable jaw member to the actuator. Translation of the actuator and linkage changes the size of the gap separating the pivotable jaw member and the other jaw member, thereby permitting the gripper arm to accommodate and engage articles of differing thicknesses.

BRIEF DESCRIPTION OF THE DRAWINGS

The foregoing and other objects, features, and advantages of the invention will be apparent from the following more particular description of the preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
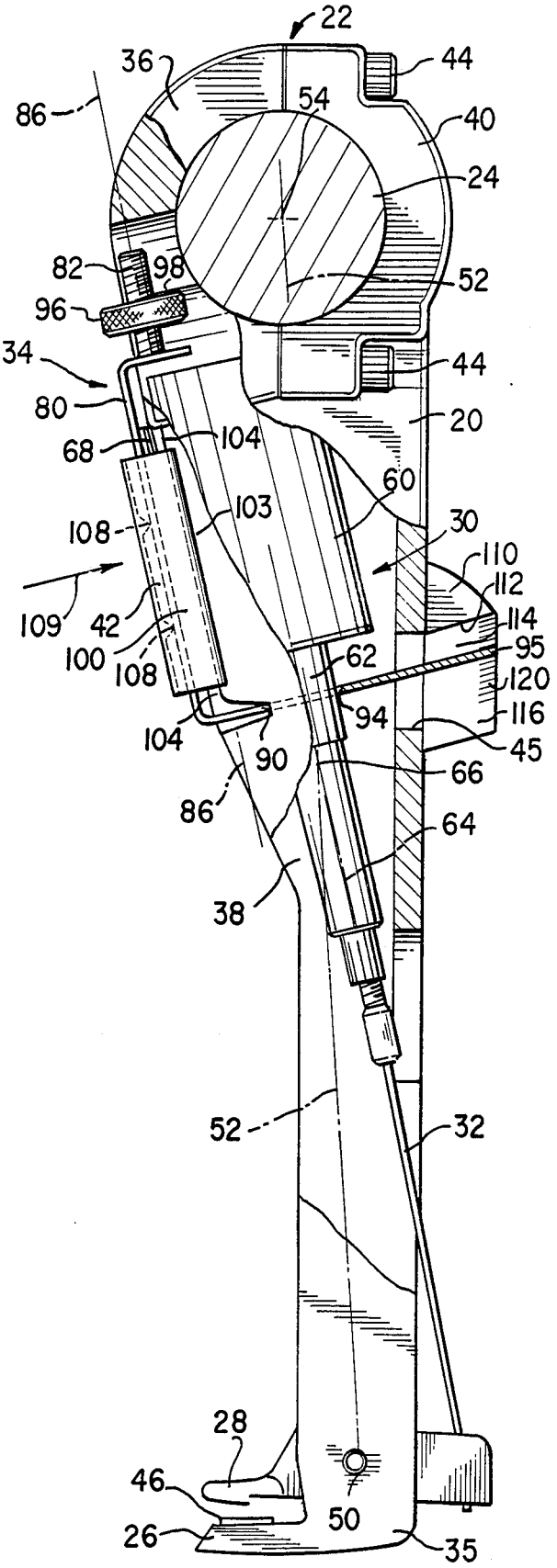
FIG. 1 is a partially cut away side view of an embodiment of the gripper arm assembly of the invention.

A gripper arm of the embodiment of FIG. 1 comprises a gripper arm housing 20; means 22 for securing the gripper arm to an oscillating drive shaft 4; a first jaw member 26; a second jaw member 28; an actuator 30; a linkage 32 for connecting the actuator 30 to the second jaw member 28; and, means 34 for displacing the actuator 30 and the linkage 32.

The gripper arm housing 20 has a first end 35 and a second end 36. The jaw members 26 and 28 are positioned proximate the first end 35 of the housing 20; the securing means 22 is provided at the second end 36 of the housing 20. The gripper arm housing 20 has a main portion 38; a cap portion 40; and, a confinement and displacement guide portion 42. The cap portion 40 comprises the securing means 22 and is a semi-cylindrical sector adapted to be fastened onto main portion 38 by bolts 44 in a manner whereby the housing main portion 38 and cap portion 40 are clamped about the oscillating drive shaft 24. An indicator through hole 45 is provided on the back of the housing main portion 38.

The first jaw member 26 is integrally formed with the housing 20 at the extremity of housing first end 35. The first jaw member 26 has a piece of high coefficient friction material 46 provided thereon to enhance article engagement.

The second jaw member 28 pivots about a pivot point 50. A reference axis 52 extends from between the radial center 54 of the shaft 24 and the pivot point 50. The second jaw member 28 is connected to a lowermost end of the linkage 32 in the manner shown and described in more detail in U.S. Pat. No. 4,634,107 already incorporated herein by reference. When the second jaw member 28 is opened relative to the first jaw member 26, a gap is formed between the first jaw memher 26 and the second jaw member 28. As described hereinafter, the size of the gap is adjustable by virtue of the provision of the actuator and linkage displacing means 34.

The actuator 30 and linkage 32 are of the types described in the incorporated U.S. Pat. No. 4,634,107. In particular, the actuator 30 is a solenoid which comprises a solenoid casing 60 and a plunger 62. The plunger 62 has a major axis 64 along which the plunger is actuatable to a first or retracted position (when an electrical signal is applied to the solenoid 60) and to a second or extended position (in the absence of the application of an electrical signal to solenoid 60). The major axis 64 of the plunger 62 intersects the reference axis 52 at a point 66 along the reference axis 52. Point 66 is between the center 54 of shaft 24 and the pivot point 50. The solenoid casing 60 has a plate 68 welded or otherwise affixed to a side thereof. The solenoid 60 is connected by a cable 70 to a connector plug 72.

The actuator and linkage displacement means 34 comprises a bracket 80 (upon which the actuator 30 is supported) and a threaded member 82 (affixed to a top portion 84 of the bracket 80) for rendering the bracket 82 translatable in a direction parallel to a major axis 86 of the threaded member 82. In the illustrated embodiment the major axis 86 is essentially parallel to the major axis 64 of the plunger 62.

Figure 2:
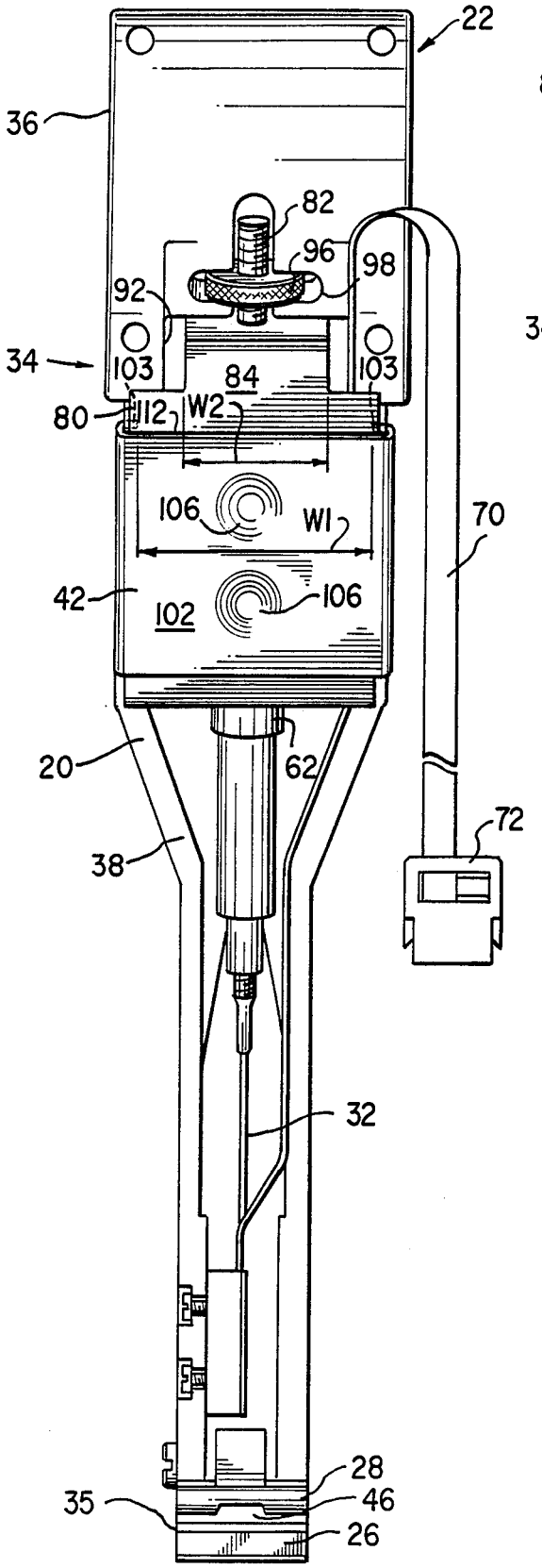
FIG. 2 is a front view of the embodiment shown in FIG. 1.

As seen from the side in FIG. 1, the bracket 80 is an essentially C-shaped member with relatively square corners. In this regard, the bracket 80 has the aforementioned top portion 84; a side portion 88; and, a bottom portion 90. The side portion 88 of bracket 80 has a width W1 as shown in FIG. 2. The top portion 84 of the bracket 80 has a narrower width W2 as also seen in FIG. 2 whereby the top portion 84 is accommodated within a channel 92 formed on the front of housing main portion 38 near its second end 36. The bracket bottom portion 90 has a circular through hole 94 formed therein through which the plunger 62 extends. The extreme end of the bracket bottom portion 90 narrows to form an indicator finger 95 which protrudes through the indicator through hole 45 provided in the back of housing main portion 38. The bracket side portion 88 is welded or otherwise fastened to the plate 68 which, it will be recalled, is in turn welded to the solenoid casing 60.

The threaded member 82 is affixed to the bracket top portion 84 and thus prevented from rotational motion. However, the threaded member 82, and hence the bracket 80, is capable of displacement along the axis 86 by virtue of the engagement of threaded member 82 with interior-threaded nut 96. As bracket 80 is translated along axis 86, actuator 30 (supported by bracket 80) is simultaneously translated along axis 64. Nut 96 is prevented from motion other than rotational motion by being confined in a slot 98 formed on the front of housing main portion 38 near its second end 36.

As seen from above, the guide portion 42 of housing 20 is essentially C-shaped with side panels 100 and a front panel 102. Side panels 100 have proximal portions thereof connected to the front panel 102 and are essentially perpendicular to front panel 102. The side panels have edges 103 formed at a distal portion thereof. The edges 103 are bent with respect to the side panels 102 whereby the edges 103 are essentially parallel to the front panel 102 and directed toward one another. Thus, side panels 100 have first mating means provided thereon for mating with respective second mating means provided on the housing main portion 38. In the illustrated embodiment, the first mating means are the edges 103 bent essentially perpendicularly to the side panels 100 and the second mating means are ridges 104 formed on the main housing portion 38. As shown in FIG. 2, edges 103 are adapted to fit over ridges 104 and thereby hold the confinement and guide portion 42 onto the main housing portion 38. Edges 103 of side panels 100 are adapted for fitting over respective ridges 104 formed on the housing main portion 38.

The front panel 102 of guide portion 42 has two dimples 106 formed on a front surface thereof. On the back surface of front panel 102 the dimples 106 form bearing points 108 which contact and confine the bracket 80 (and hence the actuator 30) to a location within housing main portion 38. In particular bearing points 108 contact and confine the bracket 80 to one dimensional motion as bracket 80 translates in a direction parallel to axis 86, and also serve as heat transfer points. As shown in FIG. 1, the confinement and displacement guide portion 42, acting through its dimples 106, exerts a force on the bracket 80 and actuator 30 in a direction (shown by arrow 109) which is essentially perpendicular to the major axis 64 of plunger 62

Figure 5:
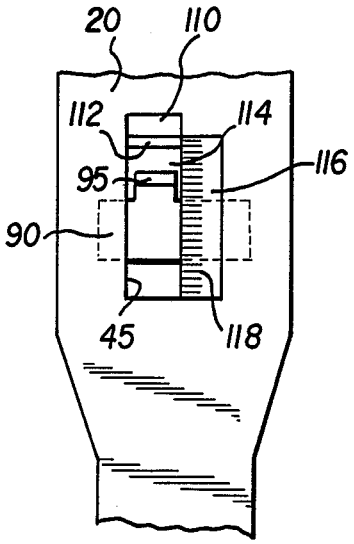

As seen in FIGS. 1 and 5, a gaging hood 110 extends perpendicularly and horizontally from the back of housing main portion 38 just above the location of indicator through hole 45. The width of the gaging hood 110 (as seen in the left to right direction of FIG. 5) is substantially the same as the width of the indicator finger 95 which protrudes through the through hole 45. An underside surface 112 of the gaging hood 110 is inclined in a manner so as to be parallel to the upper surface of the indicator finger 95. Thus, an edge of an article such as a sheet or an insert can be placed in a gaging space 114 which is between the gaging hood 110 and the indicator finger 95.

In addition to the gaging hood 110, the back of housing main portion 38 also has an indicator block 116 extending perpendicularly therefrom. The indicator block 116 is oriented essentially vertically along one side of through hole 45. Indicator block 116 has graduated scale or indicia markings 118 on the backside thereof and correspondingly aligned scale or indicia markings 120 on the side of block 116 which faces the through hole 45. The indicator finger 95 serves as a pointer with respect to the indicia markings. The indicia markings provide an indication of the magnitude of the gap separating the jaw members 26 and 28.

Figure 3:
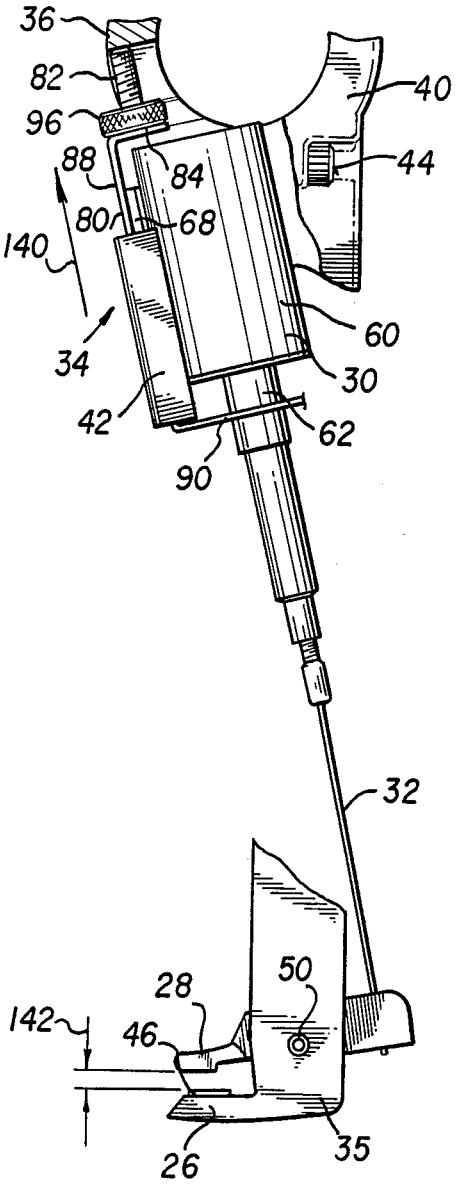
FIG. 3 is a side view of the embodiment of the invention shown in FIG. 1 wherein the gap between the jaws is adjusted for very thin sheet material.

In the operation of an insertion machine featuring the adjustable gripper arm described above, for the running of a first batch of articles a hopper associated with the gripper arm is loaded with articles of a first thickness, such as very thin sheets or inserts. In order to adjust the gripper arm for gripping and retrieving such thin sheets, an edge of such a thin sheet is placed in the gaging space 114 separating the underside surface 112 of gaging hood 110 and the indicator finger 95. Nut 96 is rotated in a manner whereby threaded member 82 is translated upwardly as shown by arrow 140 in FIG. 3. Translation of member 82 upwardly along axis 86 causes bracket 80 (and thus indicator finger 95) to be likewise translated, with actuator 30 and linkage 32 being translated in a parallel fashion along plunger axis 64. Translation of the actuator 30 and linkage 32 causes the second jaw member 28 to pivot in counterclockwise fashion about pivot point 50, thereby providing a relatively narrow gap (indicated by arrows 142) between the first jaw member 26 and the second jaw member 28.

Nut 96 is thusly rotated until the edge of the first batch sheet placed in the gaging space 114 can just barely move between the indicator finger 95 and gaging hood 110. When the sheet can just barely move in the gaging space 114, an operator standing on the backside of the gripper arm knows that the nut 96 has been rotated sufficiently to narrow the gap 142 to a first predetermined distance which is related to the thickness of the sheets which will be fed from the hopper for this first batch. In this regard, the first predetermined distance of the gap 142 for the first batch exceeds the thickness of the thin sheets loaded into the hopper for this batch by a distance necessary for facilitating proper clearance of the engagement and release operations.

Suppose it is desired to run a second batch of articles with the articles of the second batch being of paper stock of considerably greater thickness than that of the first batch. In such a situation, articles of the greater thickness are loaded into the hopper after the articles remaining from the first batch, if any, have been removed. Since the second batch involves feeding articles of considerably greater thickness, the size of the gap separating the first and second jaw members 26 and 28 must be increased.

Figure 4:
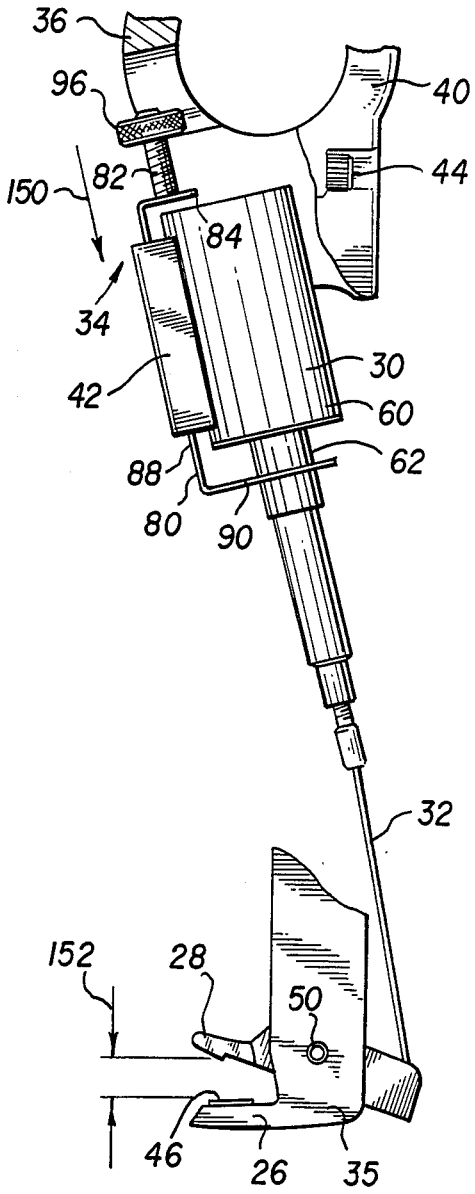
FIG. 4 is a side view of the embodiment of the invention shown in FIG. 1 wherein the gap between the jaws is adjusted for thick sheet material; and, FIG. 5 is a partial back view of a gripper arm assembly of the invention which shows a portion of a translatable bracket used as an indicator.

In the above regard, an edge of a second batch sheet is placed in the gaging space 114 in the like manner as described above with respect to the first batch. The nut 96 is rotated in a direction whereby threaded member 82 comprising the displacement means 34 rotates in the direction of arrow 150 of FIG. 4 along the axis 86. With the translation of member 82 and bracket 80 (including indicator finger 95), the actuator 30 and linkage 32 are translated in the direction of arrow 150 along the plunger axis 64. Translation of the actuator 30 and linkage 32 in this manner causes the second jaw member 28 to pivot in a clockwise fashion about the pivot point 50, thereby increasing the distance between the first and second jaw members 26 and 28, respectively, and providing sufficient clearance for the engagement or release of the thicker articles.

Nut 96 is thusly rotated until the edge of the sheet of the second batch can be accommodated in the gaging space 114. When the second batch sheet can just barely move in gaging space 114, the operator standing on the backside of the gripper arm knows that the nut 96 has been rotated sufficiently to cause the threaded member 82 to translate sufficiently to space the first and second jaw members 26, 28 apart by a second predetermined distance or gap (indicated by arrows 152) which is related to the thickness of the articles in the hopper for this second batch. In fact, the first and second jaw members 26, 28 may be separable in this manner to such an extent that, upon movement of the solenoid plunger 62 to its retracted position, the jaw members 26 and 28 do not touch one another. Thereafter the gripper arm can be operated to engage and retrieve the thicker articles from the hopper.

The provision of indicator finger 95 and gaging hood 110 on the rear of the housing portion 38 enable an operator to easily determine when the distance separating jaws 26 and 28 have been sufficiently adjusted. In this respect, jaws 26 and 28 are on the frontside of the gripper arm and face the hopper. The backside of a gripper arm is oriented away from the hopper and can be easily accessed by an operator.

Another advantage afforded by the present invention is the provision of means for dissipating the heat generated by operation of the solenoid actuator 30. In this respect, heat is transferred from the solenoid casing 60 to the plate 68, from the plate 68 to the bracket 80, from the bracket 80 to the displacement guide 42 (through dimples 106 provided on guide 42), and from guide 42 to the gripper arm housing portion 38.

While the invention has been particularly shown and described with reference to the preferred embodiment thereof, it will be understood by those skilled in the art that various alterations in form and detail may be made therein without departing from the spirit and scope of the invention.

The embodiments of the invention in which an exclusive property or privilege is claimed are defined as follows:

1. In a gripper arm for selectively engaging and retrieving articles from a station proximate the gripper arm, said gripper arm having:

a gripper arm housing having a first end and a second end;

means at the second end of said housing for securing said gripper arm to a drive shaft;

a first jaw member proximate said first end of said gripper arm housing;

a second jaw member proximate said first end of said gripper arm housing, said second jaw member being selectively movable with respect to said first jaw member for the engagement of articles therebetween;

an actuator mounted with respect to said gripper arm housing, said actuator being actuatable to a first position and to a second position;

linkage means for connecting said actuator to said movable second jaw member whereby said movable second jaw is selectively moved toward and away from said first jaw member in response to the position of said actuator, said first jaw member and said second jaw member being separated by a gap of a predetermined distance when said actuator is in the one of said positions whereat said second jaw member is moved away from said first jaw member; wherein the improven ent comprises:

adjusting means for displacing said actuator and said linkage means relative to said oscillating drive shaft, thereby adjusting the magnitude of the predetermined distance associated with said gap and facilitating the accommodation of articles of differing thicknesses between said jaws.

2. The apparatus of claim 1, wherein said actuator is a solenoid, and wherein said solenoid comprises a plunger which is actuatable to said first position when an electrical signal is supplied to said solenoid and to said second position in the absence of said electrical signal.

3. The apparatus of claim 1, wherein said adjusting means comprises:

a translatable bracket, said bracket having said actuator mounted thereon, said bracket being mounted relative to said housing in a manner whereby said bracket is translatable with respect to said housing to permit said actuator to be translatable in a direction coaxial with a major axis of a plunger comprising said actuator.

4. The apparatus of claim 3, wherein a reference axis exists from a radial center of said drive shaft to a pivot point about which said second jaw member is pivotably movable, and wherein said major axis of said plunger intersects said reference axis at a point intermediate said radial center of said drive shaft and said pivot point.

5. The apparatus of claim 3, wherein said bracket further comprises:

means for supporting said actuator,;

means attached to said supporting means for displacing said supporting means whereby said actuator is translatable in said direction coaxial with said major axis of said plunger.

6. The apparatus of claim 5, wherein said displacing means comprises a first member attached to said supporting means and which threadingly engages a second member.

7. The apparatus of claim 6, wherein said housing comprises means for preventing motion other than rotational motion of said second member.

8. The apparatus of claim 7, wherein said motion prevention means is a slot formed in said housing, said second member being confined in said slot.

9. The apparatus of claim 3, wherein said jaw members are oriented toward a front side of said gripper arm housing, wherein said gripper arm housing has a through hole provided on a rear side thereof, wherein an indicator finger extends from said translatable bracket rearwardly with respect to said gripper arm and protrudes through said through hole.

10. The apparatus of claim 9, wherein a gage member extends from the rear side of said gripper arm housing proximate said through hole in a manner whereby a gaging space is defined betwen said gage member and said indicator finger, the magnitude of said gage space being related to the magnitude of said gap separating said first jaw member and said second jaw member.

11. The apparatus of claim 9, wherein said gripper arm has scaled indicia thereon proximate said through hole, and wherein said indicator finger serves as a pointer with respect to said scaled indicia in a manner to provide an indication related to the magnitude of said gap separating said first jaw member and said second jaw member.

12. The apparatus of claim 1, further comprising:

means for providing an indication of the magnitude of said distance associated with said gap between said jaw members.

13. A method of operating a collation machine of the type wherein a gripper arm is associated with an aritcle storage hopper for engaging and retrieving articles from said hopper, said method comprising the steps:

(1) loading articles of a first thickness into said hopper;

(2) operating said gripper arm to engage and retrieve articles from said hopper in a manner whereby prior to article engagement first and second jaws comprising said gripper arm are separable by a gap of a first predetermined distance, said first predetermined distance being related to said first thickness;

(3) emptying said hopper;

(4) loading articles of a second thickness into said hopper;

(5) adjusting the size of the gap which separates said first and second jaws prior to article engagement to a second predetermined distance by displacing a jaw movement actuator relative to a drive shaft to which said gripper arm is affixed, said second predetermined distance being related to said second thickness, said adjustment being accomplished by displacing a bracket translatably mounted with respect to a drive shaft to which said gripper arm is affixed, said bracket being connected to one of said jaw members and the degree of displacement of said bracket being related to the size of said gap separating said jaw members; and, (6) operating said gripper arm to engage and retrieve articles from said hopper in a manner whereby prior to article engagement said first and secon jaws are separable by said gap of said second predetermined distance.

14. The method of claim 13, further comprising the step of:

providing an indication of the distance separating said first and second jaws and using said indication in said adjusting step (5).

15. A gripper arm for selectively engaging and retrieving articles from a station proximate the gripper arm, said gripper arm having:

a gripper arm housing having a first end and a second end;

means at the second end of said housing for securing said gripper arm to a drive shaft;

a first jaw member proximate said first end of said gripper arm housing;

a second jaw member proximate said first end of said gripper arm housing, said second jaw member being selectively movable with respect to said first jaw member for the engagement of articles therebetween;

an actuator mounted with respect to said gripper arm housing, said actuator being actuatable to a first position and to a second position;

linkage means for connecting said actuator to said movable second jaw member whereby said movable second jaw is selectively moved toward and away from said first jaw member in response to the position of said actuator;

confinement means for confining said actuator to a location within said housing, said confinement means being attachable to said housing by the engagement of first mating means provided on said confinement means with second mating means provided on said housing and, means for translating said actuator relative to said shaft, and wherein said confinement means confines said actuator to one dimensional motion.

16. The gripper arm of claim 15, wherein second mating means provided on said housing comprises ridges formed on said housing, said ridges being engagable by said first mating means.

17. The gripper arm of claim 16, wherein said confinement means comprises a member having two side panels and a front panel, said side panels having proximal portions thereof connected to said front panel and being essentially perpendicular to said front panel, said side panels having edges formed at distal portions thereof, said edges being bent with respect to said side panel whereby said edges are essentially parallel to said front panel.

18. A gripper arm for selectively engaging and retrieving articles from a station proximate the gripper arm, said gripper arm having:

a gripper arm housing having a first end and a second end;

means at the second end of said housing for securing said gripper arm to a drive shaft;

a first jaw member proximate said first end of said gripper arm housing;

a second jaw member proximate said first end of said gripper arm housing, said second jaw member being selectively movable with respect to said first jaw member for the engagement of articles therebetween;

an actuator mounted with respect to said gripper arm housing, said actuator being actuatable to a first position and to a second position;

linkage means for connecting said actuator to said movable second jaw member whereby said movable second jaw is selectively moved toward and away from said first jaw member in response to the position of said actuator;

confinement means for confining said actuator to a location within said housing, said confinement means being attachable to said housing by the engagement of first mating means provided on said confinement means with second mating means provided on said housing; and, a translatable bracket having said actuator means mounted thereon, and wherein said confinement means has provided therein at least one bearing point which contacts said bracket.

19. A method of operating a collation machine of the type wherein a gripper arm is associated with an article storage hopper for engaging and retrieving articles from said hopper, said method comprising the steps of:

(1) loading articles of a first thickness into said hopper;

(2) electrically signalling an electrically-operated jaw movement actuator to enable said gripper arm to engage and retrieve articles from said hopper in a manner whereby prior to article engagement first and second jaws comprising said gripper arm are separable by a gap of a first and second predetermined distance, said first predetermined distance being related to said first thickness;

(3) emptying said hopper;

(4) loading articles of a second thickness into said hopper;

(5) adjusting the size of the gap which separates said first and second jaws prior to article engagement to a second predetermined distance by displacying an electrically-operated jaw movement actuator relative to a drive shaft to which said gripper arm is affixed, said secodn predetermined distance being related to said second thickness; and, (6) electrically signalling said electically-operated jaw movement actuator to enable said gripper arm to engage and retrieve articles from said hopper in a manner whereby prior to article engagement said first and second jaws are separable by said gap of said second predetermined distance.

20. A gripper arm for selectively engaging and retrieving articles from a station proximate the gripper arm, said gripper are comprising:

a gripper arm housing having a first end and a second end;

means at the second end of said housing for securing said gripper arm to a drive shaft;

a first jaw member proximate said first end of said gripper arm housing;

a second jaw member proximate said first end of said gripper arm housing, said second jaw member being selectively movable with respect to said first jaw member for the engagement of articles therebetween;

a solenoid actuator having a plunger which is actuatable to said first position when an electical signal is supplied to said solenoid and to said second position in the absence of said electrical signal;

a linkage for connecting said actuator to said movable second jaw member whereby said movable second jaw is selectively moved toward and away from said first jaw member in response to the position of said solenoid plunger, said first jaw member and said second jaw member being separated by a gap of a predetermined distance when said actuator is in the one of said positions whereat said second jaw member is moved away from said first jaw member;

a translatable bracket, said bracket having said solenoid actuator mounted thereon, said bracket being mounted relative to said housing in a manner whereby said bracket is translatable with respect to said housing to permit said solenoid actuator to be translatable in a direction coaxial with a major axis of said plunger comprising said actuator, said translation of said bracket enabling the adjustment of the magnitude of the predetermined distance associated with said gap and facilitating the accommodation of articles of differing thickness between said jaws; and, a guide member for confining said solenoid actuator to one dimensional motion within said housing, said guide member having two side panels and a front panel, said side panels having proximal portions thereof connected to said front panel and being essentially perpendicular to said front panel, said side panels having edges formed at distal portions thereof, said edges being bent with respect to said side panel whereby said edges are essentially parallel to said front panel, and wherein said housing has ridges thereon which are engageable by said edges of said guide member.

* * * * *